US006465753B1

(12) United States Patent
Wang

(10) Patent No.: US 6,465,753 B1
(45) Date of Patent: Oct. 15, 2002

(54) WATER-RESISTANT SWITCH

(75) Inventor: Pai-Shan Wang, Tainan Hsien (TW)

(73) Assignee: Shin Chin Industrial Co., Ltd., Tainan Hsien (TW)

( * ) Notice: Subject to any disclaimer, the term of this patent is extended or adjusted under 35 U.S.C. 154(b) by 0 days.

(21) Appl. No.: 09/986,842

(22) Filed: Nov. 13, 2001

(51) Int. Cl.[7] ..... H01H 9/04; H01H 13/06; H01H 19/06

(52) U.S. Cl. ..... 200/302.1; 200/302.3

(58) Field of Search ..... 200/302.1, 302.2, 200/302.3, 315, 341–345

(56) References Cited

U.S. PATENT DOCUMENTS 2,773,150 A * 12/1956 Wintle ..... 200/302.2
5,722,533 A * 3/1998 Gallone ..... 200/302.1 X
6,013,885 A * 1/2000 Kowalczyk ..... 200/302.3

* cited by examiner

*Primary Examiner*—J. R. Scott
(74) *Attorney, Agent, or Firm*—Rosenberg, Klein & Lee

(57) ABSTRACT

A water-resistant switch includes a button support, and two buttons each depressably connected to one of two connecting parts formed on the upper side of the button support. The connecting parts each has several surrounding walls, which are formed one around another and in such a manner that an inner one thereof is higher than an outer one surrounding the inner one. The buttons each has two surrounding parts formed one around the other on the bottom, and are each connected to one of the connecting parts with the surrounding parts being mounted on a respective one of the surrounding walls of the connecting parts of the support.

1 Claim, 3 Drawing Sheets

WATER-RESISTANT SWITCH

BACKGROUND OF THE INVENTION

The present invention relates to a water-resistant switch, and more particularly, to one which has a button support member formed with several walls of different heights for the buttons to be connected to, thus preventing water to go therethrough.

Referring to FIG. 5, a conventional water-resistant switch includes a base 10, a button support 20 and two buttons 30. The base 10 has conductive insertion legs 101 secured to the bottom thereof, the lower ends of the legs 101 stick out, and the upper ends are received in a holding room 102 of the base 10. A rocking member (not numbered) is pivotally received in the holding room 102.

The button support 20 is connected to the upper opening of the base 10, and has two connecting cylinders 201 sticking up from the upper side; the connecting cylinders 201 each has a through hole communicating with the holding room 102. The buttons 30 each has a main body having annular wall 302 sticking down, a pushing pole 301 sticking down from the center, and a rubber seal 303 fitted onto an annular groove on the inner side of the wall 302. The pushing poles 301 are each passed into one of the connecting cylinders 201 with the rubber seals 303 being tightly mounted around the cylinders 201, and with the lower ends of the same abutting the rocking member. Thus, the buttons 30 can be depressed to control the position of the rocking member for starting or stopping the flow of electricity. And, the rubber seals 303 can prevent water from flowing through the joints between the cylinders 201 and the buttons 30.

However, the above switch is found to have drawbacks as follows:

1. Because the buttons need the rubber seals for the switch to be water-resistant, the switch consists of additional parts, i.e. the rubber seals. Consequently, the material cost is increased, and the assembly needs more labor and time.

2. After a long period of use, the rubber seals would become damaged, and therefore fails to prevent water from flowing into the switch effectively.

SUMMARY OF THE INVENTION

Therefore, it is a main object of the present invention to provide a water-resistant switch, which has fewer components, and which has water-resistance even after long period of use.

The water-resistant switch of the present invention of includes a base, a rocking member, a button support and two buttons. The base has a holding room, in which the rocking member is movably received. The button support is connect to an upper opening of the holding room, and has two upper connecting parts on the upper side; the connecting parts each has several surrounding walls formed one around another; the surrounding walls of each of the upper connecting parts are formed in such a manner that an inner one thereof has a larger height than an outer one surrounding the inner one.

The buttons each has surrounding parts formed one around another on the bottom, and a pole sticking down. The buttons are each depressably connected to one of the upper connecting parts of the support with the surrounding parts being each mounted on one of the surrounding walls, and with the poles being passed through the button support to abut the rocking member.

Thus, if water goes into the rooms between the surrounding walls, it still can't go into the base because the outer one of the walls are lower than the inner one so as to make it easier for the water to flow outwards than to flow inwards.

BRIEF DESCRIPTION OF THE DRAWINGS

This invention will be better understood by referring to the accompanying drawings, wherein.

DETAILED DESCRIPTION OF THE PREFERRED EMBODIMENT

Figure 1:
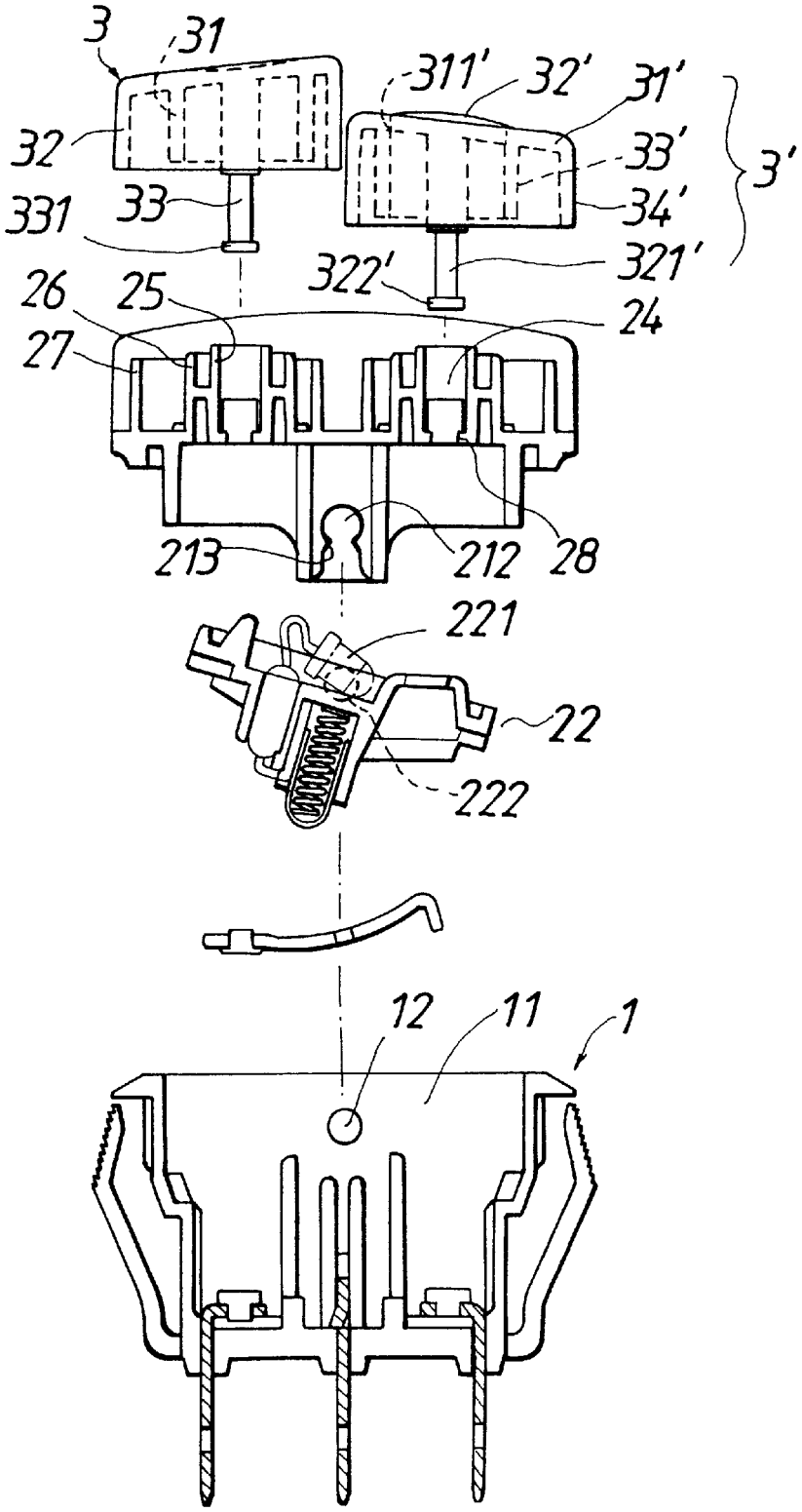
FIG. 1 is an exploded view of the water-resistant switch of the present invention.
Figure 2:
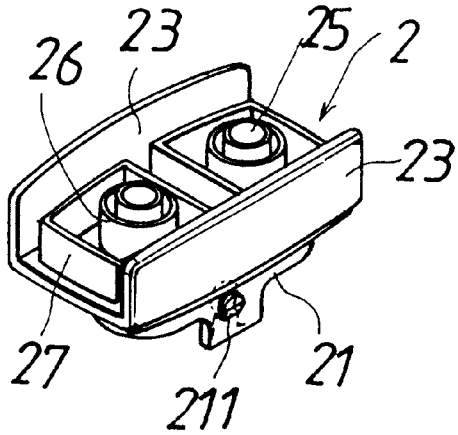
FIG. 2 is a perspective view of the button support according to the present invention.
Figure 3:
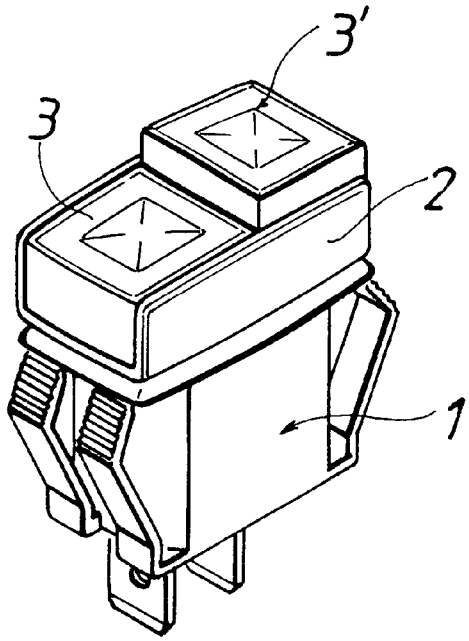
FIG. 3 is a perspective view of the switch of the present invention.
Figure 4:
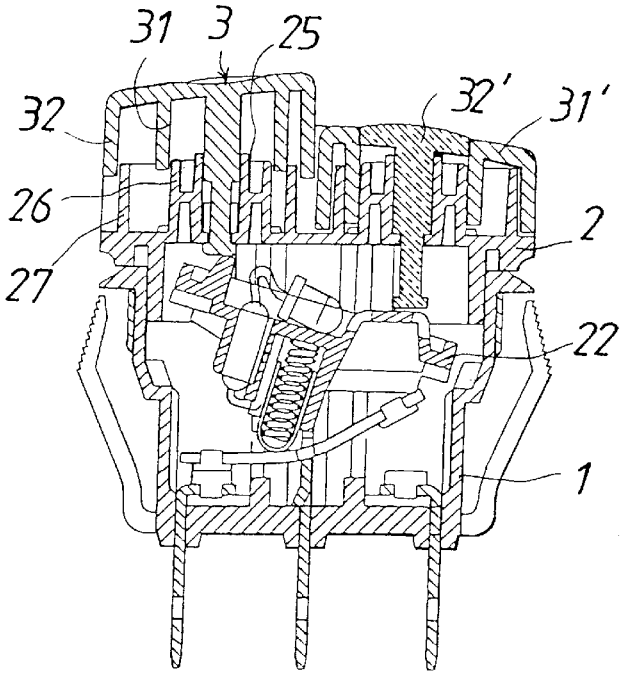
FIG. 4 is a sectional view of the switch of the present invention.
Figure 5:
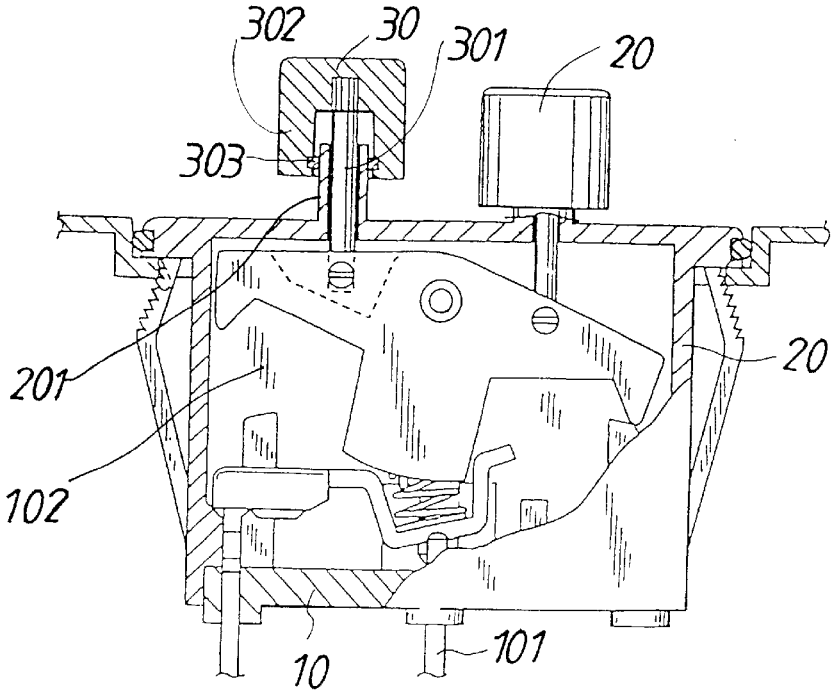
F I G. 5 (PRIOR ART)
FIG. 5 is a plan view of the conventional switch.

Referring to FIGS. 1 and 2, a water-resistant switch of the present invention includes a base 1, a button support 2 and buttons 3, 3'.

The base 1 includes a bottom, and a surrounding wall defining a holding room 11; two conductive legs (not numbered) are passed through the bottom. The base 1 further has two opposing through holes 12 on the surrounding wall thereof The button support 2 has a horizontal middle part (not numbered), a connecting part 21 sticking down from the bottom of the middle part, and two opposing lateral walls 23 sticking up from the upper side of the middle part. The connecting part 21 has two connecting protrusions 211 sticking sideways from outer sides of two opposing parts thereof and two opposing pivotal recesses 212 of the inner sides thereof; the pivotal recesses 212 each has a neck portion 213 at the middle that is narrower than the upper portion. A rocking member 22 has a main body having two pivotal protrusions 222 sticking out from two opposing sides. The rocking member 22 is pivoted to the button support 2 with the pivotal protrusions 222 being fitted into the upper portions of the recesses 212; the neck portions 213 prevent the rocking member 22 from falling off. The rocking member 22 further has a lamp 221 fitted to the upper side of the main body thereof.

In addition, the button support 2 has two upper connecting parts sticking up between the lateral walls 23 from the upper side of the middle part thereof; the upper connecting parts each includes a first surrounding wall 25, a second surrounding wall 26 around the first one 25, and a third surrounding wall 27 around the second one 26; the first wall 25 is higher than the second wall 26, and the second wall 26 is higher than the third wall 27. The middle part of the button support 2 has two through holes defined by the lower ends of the second surrounding walls 26 and 26; The through holes communicate with inner spaces 24 defined by the first surrounding walls 25.

The lower ends of the first walls 25, 25 are each formed with an annular protrusion 28 on the inner side. The button support 2 is connected to the base 1 with the connecting part 21 being fitted into the holding room 11, and with the connecting protrusions 211 being passed into the through holes 12 of the base 1; thus, the rocking member 22 is received in the holding room 11.

The button 3 has a top part (not numbered), an inner surrounding part 31 sticking down from the bottom of the top part, an outer surrounding part 32 around the inner one 31, and a pole 33 sticking down from the center of the bottom of the top part; the pole 33 is extended beyond the lower end of the walls 31 and 32, and has an annular stopped protrusion 331 at the lower end. The button 3' has a main body 31' and a transparent member 32', the main body 31' includes a top part (not numbered) having a through hole 311' and an outer surrounding parts 33' and 34' similar to the surrounding parts 31 and 32 of the button 3. The transparent member 32' has a pole 321' sticking down from the center thereof. And, the pole 321' has an annular stopped protrusion 322' at the lower end. The transparent member 32' is fixedly fitted into the through hole 311' with the pole 321' sticking down beyond the lower end of the parts 33' and 34'.

The buttons 3 and 3' are each connected to one of the upper connecting parts of the button support 2 with the poles 33 and 321' passing through the inner spaces 24 of the first walls 25 of the button support 2 and with the inner surrounding parts 31 and 33' being tightly mounted on the second surrounding walls 26 and 26 and the outer surrounding parts 32 and 34' being tightly mounted on the third walls 27 and 27; the annular protrusions 28 of the first walls 25 will engage the stopped protrusions 331 and 322' to prevent the buttons 3 and 3' from falling off when the buttons 3 and 3' are moved upwards. Thus, one of the buttons 3 and 3' can be depressed to control the position of the rocking member 22 for starting or stopping the flow of electricity; when the flow of electricity is started, the lamp 221 will emit light through the transparent member 32' as the sign.

Because of the tight connection between the upper connecting parts of the button support 2 and the buttons 3 and 3', water or dust can't go into the switch easily. Even if water goes through the joint between the buttons 3, 3' and the upper connecting parts of the support 2 and is received in the rooms between the surrounding walls 25, 26 and 27 of the support 2, it will can't go into the base 1 because the second walls 26 are lower than the first walls so as to make it easier for the water to flow out than to flow in, and the third walls 27 are lower than the second walls 26 so as to make it easier for the water to flow outwardly than to flow inwardly, i.e. water can't go into the base easily because the first walls 25 are the highest among the walls 25, 26 and 27.

Therefore, it can be seen that the switch of the present invention doesn't need additional rubber seals to be water-resistant.

What is claimed is:

1. A water-resistant switch, comprising a base having a rocking member movably received in a holding room thereof;

a button support connected to an upper opening of said holding room;

a plurality of buttons each depressably fitted to one of connecting parts of an upper side of said support with poles sticking down to abut said rocking member; and characterized by a plurality of surrounding walls formed one around another on each of said connecting parts for allowing surrounding parts formed on a bottom of each of said button to be mounted on respectively; said surrounding walls of each of said connecting parts being formed in such a manner that an inner one wall thereof has a larger height than an outer one wall surrounding said inner one wall.

* * * * *